United States Patent [19]

Borostyan

[11] 4,055,380

[45] Oct. 25, 1977

[54] TRANSFER CHARGE MAINTAINING SYSTEM

[75] Inventor: Stephen Borostyan, Victor, N.Y.

[73] Assignee: Xerox Corporation, Stamford, Conn.

[21] Appl. No.: 626,888

[22] Filed: Oct. 29, 1975

[51] Int. Cl.[2] ..... G03G 15/048

[52] U.S. Cl. ..... 355/3 R

[58] Field of Search ..... 355/37 R, 3 R, 3 CH, 355/3 TE; 96/1.4; 317/262 A; 250/324–326

[56] References Cited

U.S. PATENT DOCUMENTS

| | | | |
|---|---|---|---|
| 3,508,824 | 4/1970 | Leinbach et al. | 355/3 R |
| 3,813,548 | 5/1974 | Silverberg | 250/324 |
| 3,817,615 | 6/1974 | Adachi et al. | 355/3 TE |
| 3,850,519 | 11/1974 | Weikel, Jr. | 355/3 TR |
| 3,950,680 | 4/1976 | Micheals et al. | 317/262 A |

OTHER PUBLICATIONS

Smith; Eastman Kodak Research Disclosure; "Toner Transfer Apparatus for Automatically Adjusting Transfer Bias Potential"; pp. 16–17; Jan. 1975.

*Primary Examiner*—Donald A. Griffin
*Assistant Examiner*—M. L. Gellner

[57] ABSTRACT

In an electrostatographic copier in which imaging material is transferred from an image support surface to an overlying copy sheet in a transfer station by electrical transfer charges, the variable leakage conduction of these transfer charges by the copy sheet away from the transfer area (to contacting conductive members) changes the available transfer field strength, thus affecting transfer efficiency and quality. Here the conductive members contacting the copy sheet while it is in the transfer station are electrically connected to ground only through a high resistance whereby the transfer leakage currents through the paper provide a compensatory self-biasing floating voltage on the conductive surfaces which opposes these leakage currents.

2 Claims, 1 Drawing Figure

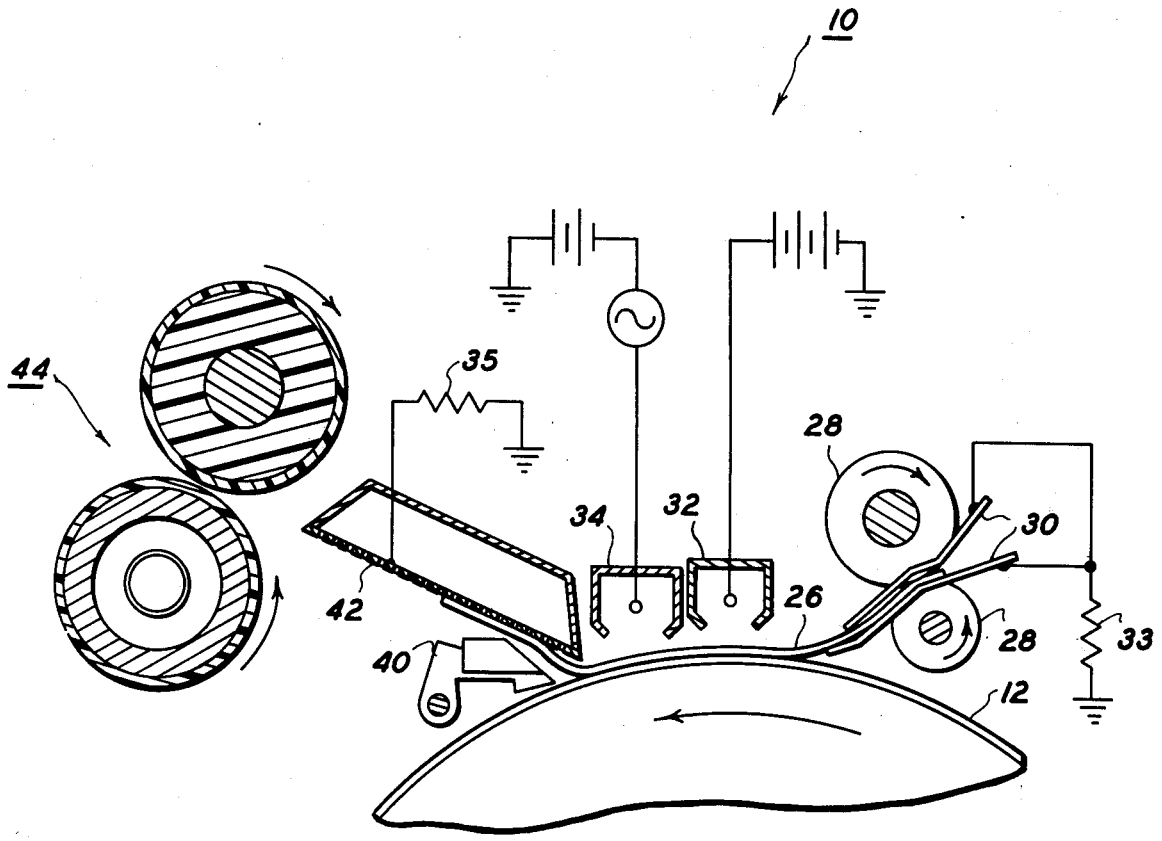
10
44
35
28
34
32
30
42
26
28
33
40
12

TRANSFER CHARGE MAINTAINING SYSTEM

The present invention relates to an image transfer system in electrostatography in which copy sheet transfer charge leakage is automatically opposed by the transfer system.

An alternative transfer charge leakage control system is disclosed in commonly assigned U.S. application Ser. No. 572,683, filed Apr. 28, 1975, by Thomas B. Michaels and George H. Place, Jr., entitled "Electrostatographic Diagnostics System" now allowed as U.S. Pat. No. 3,950,680, issued Apr. 13, 1976, and in U.S. application Ser. No. 607,746, filed Aug. 26, 1975, by those inventors together with the present inventor.

In a conventional transfer station in electrostatography, toner (image developer material) is transferred from the photoreceptor (the original support and imaging surface) to the copy sheet (the final support surface or transfer member). The toner is then fixed to the copy sheet, typically in a subsequent thermal fusing station.

In xerography, this transfer is most commonly achieved by electrostatic force fields created by D.C. charges applied to or adjacent the back of the copy sheet while the front side of the copy sheet contacts the toner-bearing photoreceptor surface. The transfer field must be sufficient to overcome the forces holding the toner onto the photoreceptor and to attract the toner over onto the overlying copy sheet. These transfer fields are generally provided in one of two ways: by corona emission, from a transfer corona generator, of charges onto the copy paper; or by an electrically biased transfer roller or belt rolling along the back of the copy sheet and holding it against the photoreceptor. The present invention relates to the electrical control of such transfer systems.

Some examples of transfer charge control systems are described in U.S. Pat. Nos. 2,951,443, issued Sept. 6, 1960, to J. F. Byrne; 3,244,083, issued Apr. 5, 1966, to R. W. Gundlach; 3,860,436, issued Jan. 14, 1975, to T. Meagher; and particularly 3,837,741, issued Sept. 24, 1974, to P. R. Spencer, and 3,805,069, issued Apr. 16, 1974, to D. H. Fisher; and 3,877,416, issued Apr. 15, 1975, to J. M. Donohue et al, teaching control with humidity changes.

The difficulties of successful electrostatographic image transfer are well known. In the pre-transfer (pre-nip) region or area, before the copy paper contacts the image, if the transfer fields are high the toner image is susceptible to premature transfer across too great an air gap, leading to decreased image resolution and, in general, to fuzzy images. Further, if there is pre-nip ionization, it may lead to strobing defects, loss of transfer efficiency, or "splotchy" transfer and a lower latitude of acceptable system operation. In the post-nip region, at the photoconductor-paper separation area, if the transfer fields are too low (e.g., less than approximately 12 volts per micron for lines, and 6 volts per micron for solid areas) hollow characters may be generated, especially with smooth papers, high toner pile heights and high nip pressures. If the fields in certain portions of the post-nip region are otherwise improper, the resulting ionization may cause image instability and paper detaching. On the other hand, in the nip region itself, to achieve high transfer efficiency and avoid retransfer, the transfer field should be as great as possible (greater than approximately 20 volts per micron). To achieve these desired electrical conditions in these adjacent regions consistently with appropriate transitions is difficult.

It is well known in the art that serious transfer problems, particularly in high humidity environments, can be caused by copy paper conduction of the applied transfer potential. E.g., U.S. Pat. No. 2,847,305, issued Apr. 12, 1958, to L. E. Walkup.

In conventional automatic xerographic apparatus, each individual copy sheet typically has its trail edge and/or lead edge areas in contact with grounded metal sheet guides, feeders, detectors, strippers or other paper path components at the upstream and downstream ends of the transfer area while another area of the same sheet is in contact with the photoreceptor and being subjected to transfer charges at the transfer station. Where the sheet has significant conductivity, it can conduct these transfer charges laterally along the sheet toward the contacting grounded components, thereby reducing (dissipating) the peak transfer charge per unit area available to produce the transfer field. This leakage also interferes with the accuracy of measurement of the transfer charge based on applied (input) charge. Merely insulating these paper path components to prevent the leakage is not a fully satisfactory solution since static electric charge build-up on them could cause other problems (image disturbances, etc.).

It is known to ground or electrically bias the substrate of an insulative coating copy sheet guide member adjacent a transfer corona generator to influence the output of that corona generator. U.S. Pat. No. 3,850,519, issued Nov. 26, 1974, to D. J. Weikel, Jr. is particularly noted in that regard.

It will be appreciated that it is generally known to have various xerographic copy sheet contacting members insulated from ground to prevent charge loss therethrough. U.S. Pat. No. 3,850,519 cited just above teaches a dielectrically coated transfer shield and copy sheet guide member. Its conductive substrate is shown grounded, but it is stated that it may alternatively be voltage biased. Likewise, it is known to change a corona generator output in response to a change in the resistivity of the surface being charged, e.g., U.S. Pat. No. 3,554,161, to R. G. Blanchette. This U.S. Pat. No. 3,554,161 discloses a ground path for the shield of a developer corona generator, which ground path is conducted through part of the photoelectric recording member itself so as to change the voltage level of the shield in response to resistance changes in that recording member and, therefore, to change the corona output.

It is also known to voltage self-bias electrodes in xerography. U.S. Pat. No. 3,599,605, issued Aug. 17, 1969, to J. C. Ralston et al teaches a development electrode self-biased by a high resistance connection to ground.

The transfer system of the invention is intended to overcome many of these problems with a simple transfer structure. It may be utilized for transfer with an imaging surface or any desired configuration, such as a cylinder or a belt. It may also be used for transfer to an intermediate surface rather than a final copy surface, and for duplex as well as simplex transfer systems.

The references cited herein teach details of various suitable exemplary xerographic or other electrostatographic structures, materials, systems and functions known to those skilled in the art, and are incorporated by reference in this specification, where appropriate.

Accordingly, the following description is confined to the novel aspects of the present invention.

Further objects, features and advantages of the present invention pertain to the particular apparatus and details whereby the above-mentioned aspects of the invention are attained. Accordingly, the invention will be better understood by reference to the following description of one example thereof, and to the drawing forming a part of the description, wherein:

The FIGURE is a schematic view of an exemplary electrostatographic copying system incorporating a transfer corona charge leakage control system in accordance with the present invention.

Referring now to the FIGURE, there is shown an exemplary electrostatographic copying system 10 in which images are formed and developed on, and then transferred from, a photoconductive surface 12. This imaging surface 12 is acted upon (charged or discharged by) various controlled corona generating devices. The general configuration, number and type of these corona generating elements per se and the xerographic arrangements may all be conventional. It will be appreciated that although individually shielded corona generators are illustrated here that it is well known that jointly or commonly shielded or unshielded corona generators may be utilized in certain situations. It is also well known that the term corona generator includes multiple wire or needle array corona generating elements as well as the single wire corona generators illustrated here. The corona generator shields here are conventionally grounded, but they may be biased instead, if desired. Likewise, the electrical power supplies are illustrated schematically since they are well known.

As shown in the FIGURE, which corresponds generally to a portion of the Xerox Corporation "4000" copier, the developed toner image is carried on the imaging surface 12 into the transfer station, where it is overlaid with a copy sheet 26 fed into registration with the toner image by conventional non-conductive copy sheet feed wheels 28 through conductive metal sheet guide members 30 outside of the transfer station. The opposite side of the copy sheet 26 from the side in engagement with the imaging surface 12 is subjected to transfer charges by a D.C. output transfer corona generator 32 to effect image transfer to the copy sheet of the toner particles by depositing transfer charges on the area of the copy sheet under the corona generator 32 sufficient to provide the desired transfer field. Then, to assist in stripping of the copy sheet from the imaging surface, the copy sheet is subjected, immediately downstream from the transfer corona generator 32 to an A.C. output (D.C. biased) detacking corona generator 34.

Stripping of the copy sheets is illustrated here by the copy sheet 26 having been initially stripped from the imaging surface 12 by a stripper finger 40. The copy sheet 26 is shown slidably supported by a conductive metal vacuum shoe 42 which holds and guides the copy sheet 26 away from the transfer station into the nip of a pair of rollers forming the image fusing station 44. U.S. Pat. No. 3,578,859, issued May 18, 1971, to W. K. Stillings describes this copy sheet transfer, stripping and vacuum transport system in greater detail.

There is a significant difference between the pre-transfer and post-transfer (stripping) areas of this illustrated xerographic system from that of a conventional xerographic system. All of the machine components which would normally contact the copy paper during the time the paper is in the transfer station are otherwise electrically insulated from ground and are directly connected to electrical ground through high resistances. As specific illustrated examples, it may be seen that both the sheet guides 30 and the vacuum shoe 42 here are directly electrically connected only with resistors 33 and 35, respectively, to feed all currents they receive through their respective resistors to ground. Thus, a voltage is generated on the components 30 and 42 equal to their ground currents times the value of their ground resistors. (Alternatively they could have a combined single resistor return).

It will be appreciated that the components 30 and 42 here are merely exemplary of various conventional input and output sheet handling, guiding, feeding, stripping or deflecting members for a xerographic transfer station. Any other such conductive members which contact a copy sheet while any part of the sheet is under the transfer corona generator would preferably be insulated and connected in the same manner through a voltage generating resistance.

As noted in the introduction, the problem to which the above-described structure and electrical connection is addressed is that in xerographic corona transfer systems it has been found that the charges placed on the copy sheet by the transfer (and detack) corona generators are, for certain conditions and copy sheet materials, conducted to a significant degree through the paper along the paper path. That is, copy sheets with relatively low resistivity can conduct the output of the transfer corona generator laterally along through the paper to grounded metal machine components which are in contact with the paper while it is being charged by the transfer corona generator, such as the sheet guides 30 and vacuum shoe 42 here. This separate ground path for the output of the transfer corona generator can lower the effective peak applied charge on the copy sheet by causing a portion of the applied charge concentration under the transfer corotron to flow away laterally therefrom through the copy sheet. This can result in a loss of transfer efficiency and/or hollow characters by reducing the maximum transfer field which can be generated for the same applied transfer charge. It can also affect the effective accuracy of a dynamic transfer corona generator current measurement system, because the output of the transfer corona generator 32 will not represent, in this situation of lateral paper current conduction to grounded surfaces, the actual charge remaining on the copy sheet to accomplish transfer.

With the transfer arrangement disclosed herein, those machine components which would otherwise provide a ground leakage path for the transfer charge through lateral conduction of the copy sheet are instead insulated from ground to contain such leakage current, and these contained leakage currents are all fed to ground through resistances to cause self-biasing of these machine components. That is, the particular solution presented here is to *self*-bias all metal parts in contact with a copy sheet during the passage of the copy sheet through the transfer station to a floating voltage which will block or counteract the tendency for lateral leakage through the copy sheet. This self-biasing can be accomplished solely by placing a large resistance between these sheet contacting components and electrical ground. With such self-biasing, the bias voltage level will increase in proportion to the amount of paper current leakage and, therefore, tend to be self-compensating with increases in paper humidity, etc., i.e., the voltage bias level on these components is self-regulating and will build-up only "as needed" as a function of, and proportional to, the leakage current. The voltage bias is also self-grounding, in that any voltage bias on these components will automatically begin discharge to ground potential as soon as the sheet passes out of contact with the component or shortly after any shutdown of the machine. This system can be very simple and inexpensive since no separate power supplies are required, only insulation of the metal paper path components at the transfer station from ground and an inexpensive resistor connection, commonly or individually, to ground.

The resistance value of the self-biasing resistors 33 and 35 is not critical, as long as this value is sufficiently high to provide the desired self-biasing function with the leakage current in the paper. 100 to 400 megohms will effectively suppress the paper leakage current affect on the transfer, by generating self-biased voltages of levels approximating the transfer voltages (e.g., over 1000 volts). However, much of the affect of high leakage (e.g., wet paper) transfer media on the transfer charge leakage can be beneficially partially compensated for with substantially lower resistance values and bias voltage levels, e.g., approximately 50 megohms and 450 volts. The resistance selected will depend, of course, on the maximum leakage current level and the applied transfer charges.

The above-described control of the effective output of the transferring corotron 32, or other corona generator, can be particularly desirable where such a corona generator is otherwise voltage sensitive. That is, where the dynamic current output of the corona generator is normally increased by a decrease in the potential of the surface which it is charging. In the case of the transfer corotron 32 this output-influencing potential is the charge on the paper-toner-air-photoreceptor sandwich under the transfer corotron 32. This potential is reduced by the above-described lateral current leakage of the charge by the copy paper away from the area under the transfer corotron. The lateral conduction of transfer charges is quite significant for papers which have been in a high relative humidity environment or which have low surface resistivity. If the transfer corona generator output is allowed to increase too greatly, (in an attempt to maintain a desirable level of peak transfer field intensity under the transfer corotan) the lateral charge conduction of the sheet can carry these charges along the sheet into the pre-transfer area of the sheet which has not yet made contact with the imaging surface. This can cause an excessive transfer field acting on an area of the copy sheet prior to that area of the copy sheet engaging the imaging surface. That can cause undesirable air gap pre-transfer or "toner jumping", which can result in fuzzy or blurred images. This undesired pre-transfer condition, therefore, imposes a limitation on the extent to which the output current of the transfer corona generator 32 can be raised to compensate for the drop in peak transfer potential on the copy sheet caused by a lateral conduction. With the charge leakage control arrangement shown here the transfer corona output current can be held substantially constant, or caused to increase only within pre-set limits, or at a pre-set rate, in response to the potential under the corona generator.

In conclusion, there has been disclosed herein an improved transfer charge control system. Numerous advantages and applications, in addition to those described above, will be apparent to those skilled in the art. While the embodiments generally disclosed herein are generally considered to be preferred, numerous variations and modifications will be apparent to those skilled in the art. The following claims are intended to cover all such variations and modifications as fall within the true spirit and scope of the invention.

What is claimed is:

1. In an electrostatographic copying apparatus in which imaging material is transferred from an image support surface to overlying variable resistance copy members in a transfer station by electrical transfer means which deposit transfer charges on the copy member, and in which electrically conductive copy member guide members outside of the transfer station conductively contact the copy member while the copy member is in the transfer station and thereby can receive leakage currents of said transfer charges through said copy member affecting the transfer of said imaging material, the improvement wherein:

self-biasing means are provided for automatically self-biasing said conductive guide members to a voltage level proportional to the level of said leakage current of transfer charges through the copy member to said conductive guide members, wherein said self-biasing means consists solely of 100 to 400 megohm resistance means electrically connecting between said conductive guide members and electrical ground to conduct said leakage current of transfer charges therethrough to self-bias said conductive guide members to a voltage level proportional to said transfer charge leakage current to said conductive guide members generated across said resistance means only by said transfer charge leakage current therethrough from said conductive guide members, said self-biased voltage level being sufficiently high to effectively suppress the conduction of said transfer charge leakage currents to said conductive guide members, and said resistance means providing the only electrical connection between said conductive guide members and electrical ground.

2. The electrostatographic copying apparatus of claim 1, wherein said conductive members are individually electrically connected to ground through individual resistors.

* * * * *